US005819750A

United States Patent [19]

Moyer

[11] Patent Number: 5,819,750

[45] Date of Patent: Oct. 13, 1998

[54] DIVOT REPAIR CIGAR CLIP AND CUTTER TOOL

[76] Inventor: Martin D. Moyer, 105 Country Club View Dr., Lebanon, Pa. 17042

[21] Appl. No.: 842,261

[22] Filed: Apr. 24, 1997

[51] Int. Cl.[6] ..... A24D 1/12

[52] U.S. Cl. ..... 131/175; 131/187; 131/330

[58] Field of Search ..... 131/175, 330, 131/187, 240.1, 241, 248, 250; 273/32 B, 32 A; 248/530; 172/380, 378

[56] References Cited

U.S. PATENT DOCUMENTS

| | | | |
|---|---|---|---|
| D. 300,160 | 3/1989 | Johnson | D21/234 |
| D. 375,815 | 11/1996 | Kagasoff | D27/183 |
| 1,166,881 | 1/1916 | Anderson | 131/240.1 |
| 3,071,141 | 1/1963 | McIlwain | 131/330 |
| 4,063,731 | 12/1977 | Kitay | 273/32 B |
| 4,151,937 | 5/1979 | Javosh et al. | 224/252 |
| 5,116,046 | 5/1992 | Pace | 273/32 B |
| 5,121,519 | 6/1992 | Haugom | 15/105 |
| 5,226,647 | 7/1993 | Notarmuzi | 273/32 B |
| 5,305,999 | 4/1994 | Tate | 273/32 B |
| 5,393,052 | 2/1995 | Kennedy | 273/32 B |
| 5,401,019 | 3/1995 | Wissman et al. | 273/32 B |
| 5,562,553 | 10/1996 | Digerness et al. | 473/408 |

*Primary Examiner*—John G. Weiss
*Assistant Examiner*—Charles W. Anderson
*Attorney, Agent, or Firm*—Thomas Hooker, P.C.

[57] ABSTRACT

A golfer's tool includes a body, a pair of prongs, a cutter, and a clip. The pair of prongs extend from one end of the body and are used in repairing ball marks. The cutter includes a slidable blade within the body and a central passage extending through the body transversely of the path of the blade. The blade is used to cut the tip off a cigar inserted in the central passage. The clip is mounted on a portion of the tool away from the pair of prongs and includes a spring located between two sets of arms. The spring biases one of the sets of arms towards the other for holding a cigar or cigarette.

14 Claims, 2 Drawing Sheets

DIVOT REPAIR CIGAR CLIP AND CUTTER TOOL

FIELD OF THE INVENTION

The invention relates to a combination divot repair tool, cigar holder and cigar cutter.

BACKGROUND

The game of golf is played on grass fairways and carefully tended putting greens. The maintenance of the grass on the greens is an important and delicate task. The grass must be frequently watered and treated with fertilizer and chemicals. Particular care is given to the grass on the putting greens to keep the surface smooth for putting.

The impact of the golf ball landing on the putting surface may damage the grass by causing a divot. It takes a long time for the grass surface to re-grow over unrepaired divot marks. Golfers are encouraged to repair the divots. Immediate repair of divot marks allows others to play on a smooth putting surface and permits the grass to recover rapidly.

Golfers carry a divot repair tool to repair the divots on the putting surface. A divot repair tool typically has a body with a pair of prongs at one end. The body is held and the prongs are inserted into the ground around the divot. By prying up the damaged grass with the prongs, the putting surface is repaired and the grass is able to rapidly take root in the surface.

Many golfers enjoy smoking while playing golf. Due to the rapid pace and required physical activity, the smoking golfer is faced with a dilemma. When it becomes the smoking golfer's turn to play, he must put aside his cigarette or cigar. The golfer can either walk a distance and place his cigarette or cigar on a suitable clean surface or he can place it on the ground. Placing it on the ground exposes the cigarette or cigar to dirt and chemicals used to maintain the grass.

The cigar smoker is faced with the additional problem of cutting the tip off the cigar. The cigar smoking golfer usually carries an additional tool to cut off the tip of the cigar.

SUMMARY OF THE INVENTION

The invention is a useful golfer's tool that includes divot repair prongs, cigar holding clip and cigar cutter in one convenient tool. The tool has an elongate plastic body with the pair of prongs extending away from one end, a cutting slide mounted in the body and a holding clip joined to the other end of the body.

The prongs are similar to the prongs found on a conventional divot repair tool. The golfer can insert the prongs into the ground surrounding the divot and repair the surface by prying up the damaged grass. The prongs are angled to facilitate repair of the grass and smoothing of the surface.

The tool includes a holding clip joined to the end of the body away from the prongs. The clip is sized to securely hold a cigarette or large cigar. When it is the golfer's turn to play, his cigarette or cigar can be clipped to the tool and the tool can be inserted into the ground to safely hold the cigarette or cigar above the grass.

The slide moves in the body and includes a blade. The body has a circular passage extending through the body perpendicular to the slide. Extending the slide opens the passage and permits the golfer to insert the tip of a cigar into the circular passage. Retraction of the slide causes the blade to cut the tip of the cigar.

The invention is a convenient tool for the golfer which enables him to repair divot marks on the playing surface, securely hold a cigarette or cigar above the ground while playing, and cut the tip off the end of the cigar.

Other objects and features of the invention will become apparent as the description proceeds, especially when taken in conjunction with the accompanying drawings illustrating the invention, of which there are two sheets and one embodiment.

DESCRIPTION OF THE PREFERRED EMBODIMENT

Figure 1:
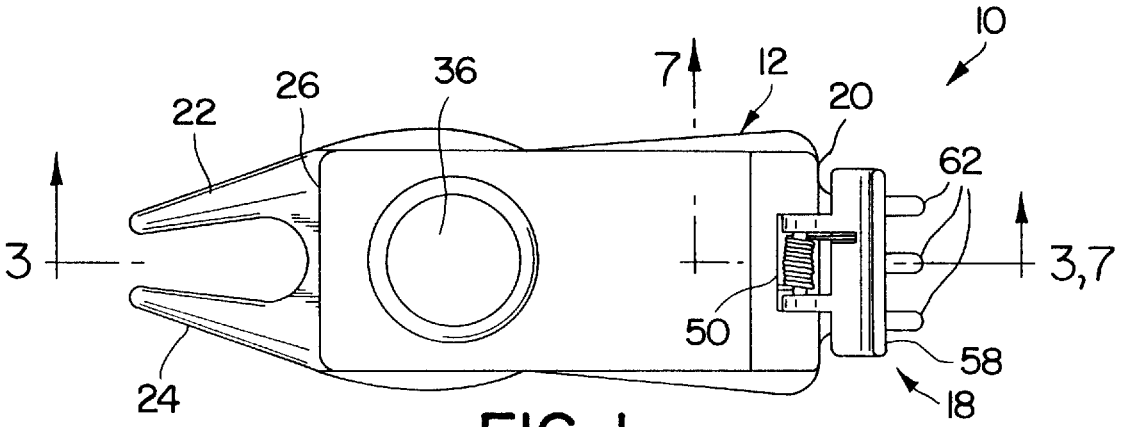
FIG. 1 is a top view of a divot repair, cigar clip and cutter tool according to the invention.

Divot repair, cigar clip and cutter tool 10 has an elongate plastic body 12, a flat elongate slide 14 mounted within a narrow slot 16 in body 12, and a holding clip 18 joined to a first end 20 of the body 12.

Figure 2:
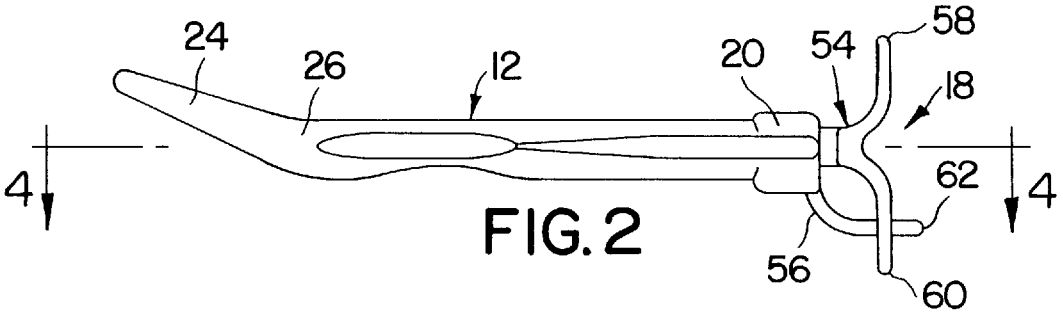
FIG. 2 is a side view of the tool according to the invention.
Figure 3:
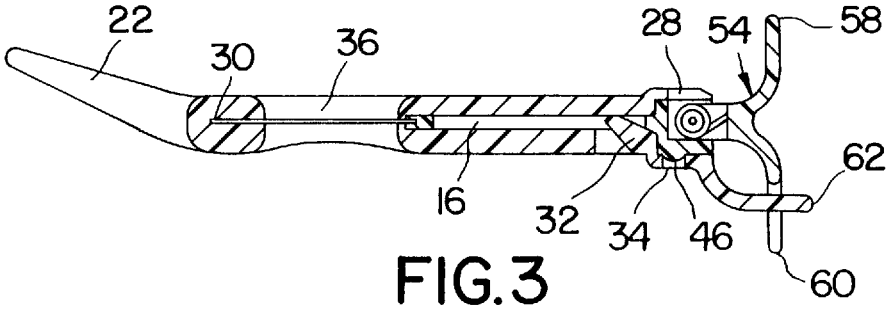
FIG. 3 is a sectional side view of the tool taken generally along lines 3—3 of FIG. 1.
Figure 4:
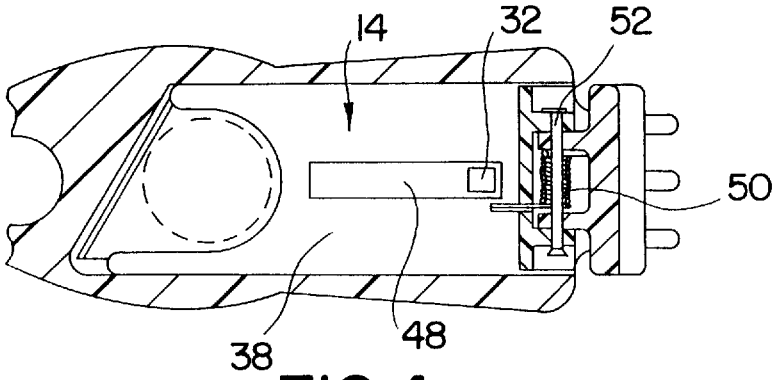
FIG. 4 is a sectional top view taken generally along lines 4—4 of FIG. 2.

Body 12 has a pair of spaced apart tapered prongs 22 and 24 at the second end 26. Each prong 22 and 24 has one end joined to body 12 and extends upward at a slight angle away from body 12. See FIGS. 1 and 2. Slot 16 has an open end 28 away from prongs 22 and 24. Slot 16 forms a narrow cavity within the length of body 12 extending from open end 28 to a closed end 30 adjacent prongs 22 and 24.

Figure 6:
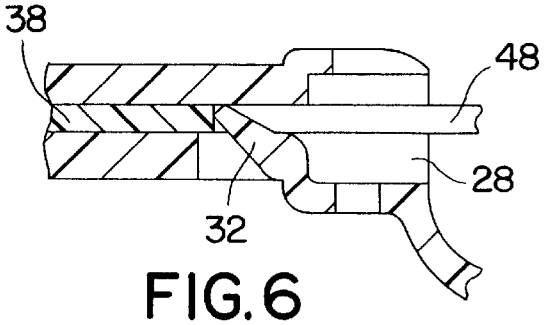
FIGS. 6 and 7 are partial sectional side views taken generally where indicated in FIGS. 1 and 5.

Body 12 also has a latch 32 projecting into slot 16 and a hole 34 in one side of the body adjacent the open end 28. Latch 32 projects from the center of one side of body 12 into slot 16. See FIG. 6. A generally circular central passage 36 extends transversely through body 12. Passage 36 extends through body 12 perpendicular to slot 16 adjacent the closed end 30 of the slot.

Figure 7:
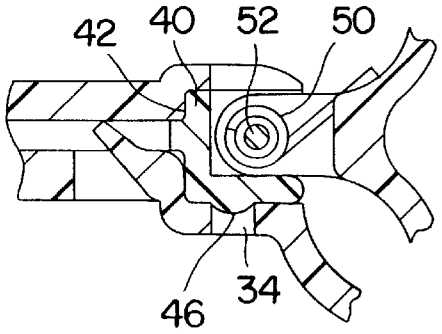
Figure 10:
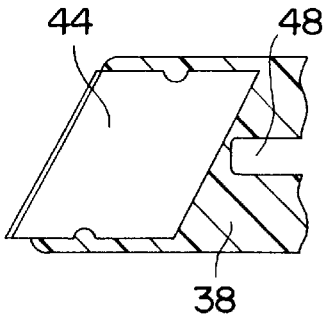
FIG. 10 is a partial sectional top view of an end of the slide according to the invention.

Slide 14 has a flat member 38. Member 38 is freely slidable within slot 16 and includes rear shoulders 40 that engage rear stops 42 of the open end 28 when member 38 is fully inserted in the body. See FIGS. 6 and 7. A blade 44 is joined to one end of member 38 and extends outwardly with the cutting edge of blade 44 forming an angle in the plane of travel. See FIG. 10.

A dome-shaped protrusion 46 forms a half spherical projection extending from one side of member 38 perpendicular to the plane of travel. Protrusion 46 is located adjacent the end of member 38 opposite blade 44. Protrusion 46 rests within hole 34 when member 38 is fully inserted in body 12. A rectangular opening 48 extends through the center of member 38. Opening 48 is sized to receive latch 32. Latch 32 is positioned within opening 48 to prevent member 38 from being fully withdrawn from body 12. When slide 14 is fully inserted in slot 16, latch 32 is located adjacent the end of opening 48 near protrusion 46. When slide 14 is fully extended, latch 32 engages the end of opening 48 near cutting edge 44.

Clip 18 has a coiled spring 50, a pin 52 extending axially through the center of spring 50, a rotating member 54 rotatably joined to pin 52, and a stationary member 56 joined to body 12 adjacent the open end 28.

Pin 52 extends through the center of spring 50 and is joined to member 38 on both ends. Rotating member 54 is joined to pin 52 adjacent ends of spring 50. Rotating member 54 is freely rotatable about pin 52 and engages a free end of spring 50. Rotating member 54 includes a handle 58 extending to one side of pin 52 perpendicular to the direction of rotation of member 58 and four spaced arms 60 extending to the opposite side of pin 52. Stationary member 56 is joined to the end of body 12 adjacent the open end 28 and extends away from body 12 parallel the path of travel of member 38. Stationary member 56 includes three spaced arms 62 aligned parallel the path of travel for member 38 and between arms 60.

The operation of the invention will now be described.

One of the functions of tool 10 is the repair of divots. For repairing divots, prongs 22 and 24 are used. A golfer firmly grasps the body 12 and inserts prongs 22 and 24 into the ground around the divot. The golfer gently tilts body 12 away from the divot causing prongs 22 and 24 to rotate up underneath the divot raising the ground within the mark. The golfer continues this around the entire circumference of the ball mark so that the compressed ground is returned to its original level and the grass is returned to its original position.

Figure 8:
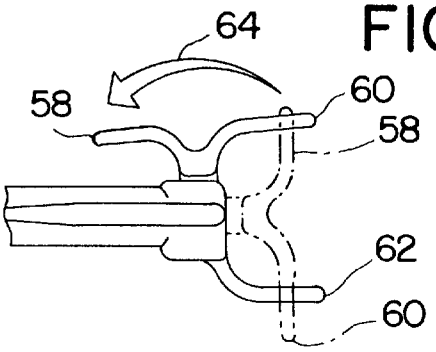
FIG. 8 is a partial side view similar to FIGS. 6 and 7 showing the clip opened and closed.
Figure 9:
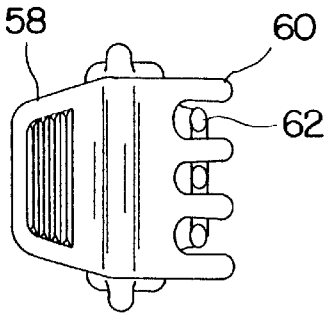
FIG. 9 is an end view of the tool taken as indicated by line 9 in FIG. 5.

Tool 10 also holds cigarettes and cigars. When acting as a clip, tool 10 securely holds a cigarette or cigar between arms 60 of rotating member 54 and arms 62 of stationary member 56. To clip a cigarette or cigar, the golfer retracts slide 14 to a fully seated position in body 12. In this position, rotating member 54 is adjacent stationary member 56 with arms 62 extending between arms 60. This is the fully closed position of the clip. See FIGS. 2 and 9. Prior to inserting the cigarette or cigar, the golfer opens the clip 18. Clip 18 is fully opened by applying pressure to handle 58. This rotates member 54 about pin 52. Rotation of member 54 rotates arms 60 away from arms 62 creating a gap between arms. FIG. 8 shows clip 18 in the fully opened position and the dashed lines illustrate the clip in the fully closed position. Pressure on handle 58 rotates member 54 in the direction shown by arrow 64. The free end of spring 50 engages member 54 biasing the member towards the fully closed position. Once the pressure is applied to the handle 58 and clip 18 is opened, the golfer inserts his cigarette or cigar. After insertion of the cigarette or cigar, pressure is removed from surface 58. Spring 50 biases rotating member 54 towards stationary member 56 thus securely holding a cigar or cigarette between arms 60 and 62.

When it becomes the smoking golfers turn to play, the cigarette or cigar is securely clipped by the tool 10. The golfer then inserts prongs 22 and 24 in the ground. In this position, the cigarette or cigar is securely held off the ground leaving the smoking golfer free to play.

Figure 5:
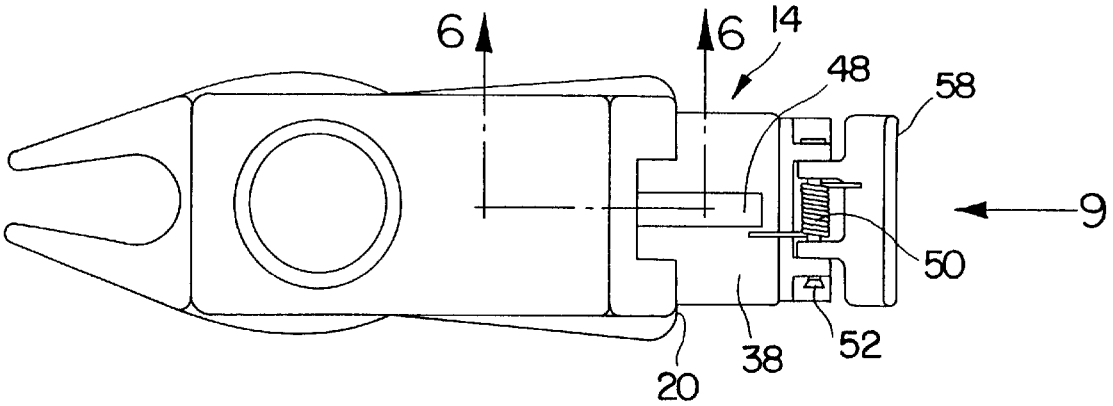
FIG. 5 is a top view similar to FIG. 1 with the slide extended.

Tool 10 is also very useful in cutting the tip off a cigar. Slide 14 is first extended from body 12 as shown in FIG. 5. Latch 32 slides within opening 48. See FIG. 6. When slide 14 reaches its fully extended position, latch 32 engages the end of opening 48. This prevents slide 14 from becoming separated from body 12. In the fully extended position, blade 44 is spaced from the closed end 30 of slot 16 such a distance that central passage 36 is completely cleared. The tip of the cigar is then inserted into central passage 36. To cut the tip from the cigar, slide 14 is forcefully retracted into body 12. The retraction of slide 14 moves blade 44 across the opening created by passage 36. Blade 44 will cut through the portion of the cigar within passage 36.

Rear shoulders 40 of slide 14 engage rear stops 42 of body 12 when the slide 14 is fully retracted. See FIG. 7. This prevents blade 44 from contacting the closed end of slot 16. By stopping blade 44 short of contacting the end of slot 16, the life of blade 44 will be extended.

In the fully retracted position, movement of slide 14 is prevented by protrusion 46. Protrusion 46 extends away from one side of slide 14 perpendicular to the path of travel. When in the fully retracted position, protrusion 46 extends within hole 34. See FIG. 7. An attempt to extend 14 from this position causes protrusion 46 to contact the sides of hole 34. In order to extend slide 14, it is necessary to exert sufficient force to cause protrusion 46 to rise out of hole 34. The thickness of body 12 adjacent the opening of slot 16 allows a minimal amount of force to deform the opening making it wider. By widening the opening, it is possible to pull protrusion 46 out of hole 34 and extend slide 14.

While I have illustrated and described the preferred embodiment of my invention, it is understood that this is capable of modification and I, therefore, do not wish to be limited to the precise details sets forth, but desire to avail myself of such changes and alterations as fall within the purview of the following claims.

What I claim as my invention is:

1. A golfer's tool, comprising:

a body having opposed sides;

a plurality of prongs, each prong joined at one side to said body and extending away from said body;

a passage extending through said body;

a slide blade movably mounted on said body, said blade including a cutting edge moveable past said passage; and a rotatable spring loading clip for holding a cigar or cigarette, said clip located at said other side of the body and mounted on a portion of said tool away from said plurality of prongs.

2. The tool as claimed in claim 1, wherein said body includes a narrow slot, said slot extending from said other side of said body to said one side of said body adjacent said plurality of prongs; and said slide blade is mounted within said slot.

3. The tool as claimed in claim 2, wherein said body includes a blade retention member in said slot;

said slide blade includes an opening; and said blade retention member extends into said opening.

4. The tool as claimed in claim 3, wherein said slide blade includes a projection extending from one side thereof and said body includes a recess in one side thereof, said projection fitting in said recess when said slide blade is completely mounted on said body.

5. The tool as claimed in claim 1, wherein said clip includes a first plurality of arms on the body, a second plurality of arms and a spring biasing said first and second arms toward each other.

6. The tool as claimed in claim 5, wherein said clip includes a hinge between said first and second plurality of arms and said spring comprises a coiled spring.

7. The tool as claimed in claim 5 wherein the first plurality of arms are located between the second plurality of arms and the clip includes a handle.

8. A tool for use during playing of the game of golf comprising:

a flat elongate body;

a prong on one end of the body for repairing a ball mark;

a cutter for severing the tip of a cigar; and a clip adjacent the other end of the body for holding a cigar or cigarette, said clip including a pair of opposed retention members, a spring biasing one retention member toward the retention member and a handle on said one member.

9. A tool as claimed in claim 8, wherein said clip includes a pair of arms and said spring biasing one arm past the other arm.

10. A tool as claimed in claim 9, wherein said clip includes two plurality of arms spaced between each other, said handle joined to one set of arms.

11. A tool as claimed in claim 1, wherein said clip includes spaced apart retention members and a spring biasing said retention members toward each other.

12. A tool as claimed in claim 11, wherein said clip includes a hinge joined to one retention member and a handle on said one retention member.

13. A tool as claimed in claim 11, wherein a first retention member is mounted on said blade.

14. A tool as claimed in claim 13, wherein a second retention member is mounted on said body.

* * * * *